United States Patent [19]

Ulrich et al.

[11] Patent Number: 4,811,744

[45] Date of Patent: Mar. 14, 1989

[54] APPARATUS FOR MEASURING THE DRAW RESISTANCE OF A ROD OF TOBACCO FIBERS

[75] Inventors: Jörn Ulrich, Bönningstedt; Friedrich Weinhold, Norderstedt; Meinhard Meyer, Appen-Unterglinde, all of Fed. Rep. of Germany

[73] Assignee: B.A.T. Cigarettenfabriken GmbH, Hamburg, Fed. Rep. of Germany

[21] Appl. No.: 171,343

[22] Filed: Mar. 21, 1988

[30] Foreign Application Priority Data

Apr. 2, 1987 [EP] European Pat. Off. ..... 87104881

[51] Int. Cl.[4] ..... A24C 5/14

[52] U.S. Cl. ..... 131/84.1; 131/28; 131/280; 131/904

[58] Field of Search ..... 131/84.1, 280, 28, 904

[56] References Cited

U.S. PATENT DOCUMENTS

| | | | |
|---|---|---|---|
| T941,011 | 5/1974 | Morrison et al. . | |
| 3,411,513 | 11/1968 | Knobel | 131/280 |
| 3,595,067 | 7/1971 | von der Lohe et al. | 131/904 X |
| 3,633,590 | 1/1972 | Pocock | 131/904 X |
| 3,921,644 | 11/1975 | von der Lohe et al. | 131/84.1 |
| 4,103,535 | 8/1978 | Mutter et al. | 131/904 X |
| 4,615,342 | 10/1986 | Federle et al. | 131/84.1 |
| 4,685,475 | 8/1987 | Ridler et al. | 131/84.1 |

FOREIGN PATENT DOCUMENTS

| | | |
|---|---|---|
| 1166069 | 3/1964 | Fed. Rep. of Germany . |
| 1902954 | 8/1970 | Fed. Rep. of Germany . |
| 2332384 | 1/1975 | Fed. Rep. of Germany . |
| 0982001 | 2/1965 | United Kingdom . |
| 1588506 | 4/1981 | United Kingdom . |

*Primary Examiner*—V. Millin
*Assistant Examiner*—Joe H. Cheng
*Attorney, Agent, or Firm*—Armstrong, Nikaido, Marmelstein & Kubovcik

[57] ABSTRACT

An apparatus for the continuous measurement of the draw resistance of a cigarette, comprising transducer which detects the pressure drop of a gas stream with constant volume, said gas stream being introduced at a format finger of a rod-producing machine into a rod of tobacco fibres. The measured value depending on the flow resistance of said rod is continuously determined and correlates very well with the usual static measurement of the draw resistance of cigarettes, i.e. of the tobacco rod of a cigarette, so that this continous draw resistance measurement during the cigarette production replaces not only the conventional random check but can also be used for controlling the production operation.

12 Claims, 2 Drawing Sheets

APPARATUS FOR MEASURING THE DRAW RESISTANCE OF A ROD OF TOBACCO FIBERS

BACKGROUND OF THE INVENTION

1. Field of the Invention

The invention relates to an apparatus for measuring the draw resistance of a rod of tobacco fibres, comprising a source for a gas stream passing through the rod and a measuring-value transducer for determining the pressure drop of the gas stream occuring with constant gas volume at the rod.

2. Description of the Prior Art

In the quality control of cigarettes the draw resistance of the cigarette is of great importance because from draw-resistance measurements, it is possible to determine in a relatively simple manner whether a cigarette permits the desired draw or puff volume. The draw volume of a cigarette is in turn governed on the one hand by the manner in which the smoker smokes the cigarette and on the other hand by its draw resistance.

Thus, to ensure for the smoker of a given brand cigarette always the same draw volume—keeping the subjective parameter, that is the manner how the smoker smokes the cigarette, constant—the draw resistance must be kept to a fixed value.

To ensure that this constant draw-resistance value is maintained, individual cigarettes are taken in random checks from the every day production and their draw resistance is determined with a device as described, for example, in the article "The Measurement of Smoking Parameters with the Aid of Parameter Converters", published in "*Beitrage zur Tabakforschung*", Volume 6, No. 1, July 1971. In this method the cigarette is connected by means of a rubber lip to a smoking machine which, for example, draws a gas flow with constant volume through the cigarette. In accordance with the usual standardization, the constant flow volume at the exit side should be 17.5 $cm^3$/sec.

Due to the flow resistance of the cigarette, a pressure drop occurs between the entry side and exit side of the gas flow and is referred to as "draw resistance"; it can be measured by a pressure transducer.

Alternatively, it is fundamentally also possible to measure the gas volume passing with constant pressure drop through the cigarette.

These apparatuses are however, only suitable for carrying out random checks, i.e. they cannot be used for every day, continuous measurement of the draw resistance of all cigarettes, as for example those made by a certain cigarette machine, because each cigarette must be inserted into the apparatus and measured individually. These random checks can only be carried out at predetermined intervals of time so that in general it is not possible to react immediately to a detected change of the draw resistance of the cigarette by appropriate regulation of the production.

British Pat. No. 1,588,506 discloses an apparatus for measuring the draw resistance of a rod of filter fibres, with which the pressure drop at the rod is determined in a region at which the rod has reached almost its final cross-section. The intention is to detect the pressure drop at a point behind the smallest cross-section of the rod of filter material because there the filter fibres have reached their final position and thus can no longer be displaced by the air passing through the rod. The main compression of the rod is by means of a wheel, whilst the shaping and subsequent compression is carried out by a format finger which is arranged in the movement direction of the rod behind the wheel.

An apparatus for measuring the draw resistance of a rod of tobacco fibres is disclosed in German Auslegeschrift No. 1 166 069 and comprises a source for a gas flow passing through the rod and a measuring-value transducer for determining the pressure drop of the gas flow with constant gas volume occuring at the rod or of the gas volume with constant pressure drop passing through the rod. A pump passes the air through the tobacco stream into an enclosed space of constant volume which is formed between a trough, through which the format belt draws the tobacco stream and a member opposite said trough, for instance a pressure shoe or a tongue known per se.

Admittedly, this permits the continuous measurement of the draw resistance of a rod of tobacco fibres., the value determined is also specific for the rod of tobacco fibres so that the determined draw resistance can be used for process control purposes. A disadvantage, however, is that the draw resistance of the rod of tobacco fibres thus determined does not correlate with the draw resistance of the finished cigarette, which is a very important product parameter because it is an essential characteristic of a specific cigarette type.

SUMMARY OF THE INVENTION

The invention is thus based on the problem of providing an apparatus for measuring the draw resistance of a rod of tobacco fibres of the type described in which the afore-mentioned disadvantages are obviated.

In particular a measuring apparatus is proposed whose measured value is correlated in an exactly defined manner with the draw resistance of the finished cigarette made from said tobacco rod.

The invention therefore proposes in an apparatus for measuring the draw resistance of a rod of tobacco fibres comprising a source for a gas stream passing through the rod and a measuring-value transducer for determining the pressure drop of the gas stream with constant gas volume occurring at the rod the improvement being that the format finger made from hard metal of a rod-producing machine for the manufacture of smokable articles comprises at a point at which the diameter of the rod corresponds substantially to the diameter of the finished tobacco rod at least one opening for subjecting the rod to the gas stream, and that the one or each opening is connected via a critically traversed nozzle in the supply conduit to the gas source.

Expedient embodiments are defined by the features of the subsidiary claims.

The advantages achieved with the invention are based on the following mode of operation which will be explained with reference to the example of the continuous manufacture of cigarettes: In the manufacture of cigarettes the tobacco stream coming from a distributor is conveyed in an air flow to a perforated suction belt, thereby forming a continuous tobacco rod. At so-called "timer discs" this tobacco rod is brought in a weight-controlled machine to its desired weight and transferred with the aid of the suction belt to a transfer station. At the latter the tobacco rod, which at this instant is not yet compacted, is taken over by a format belt which is covered with the cigarette paper. In a following format finger the tobacco rod, which has a substantially circular cross-section, is continuously compacted from the diameter present there of about 11 mm to a diameter of about 6.8 mm. This compacting of the tobacco rod beyond the diameter of the finished cigarette, which is about 8 mm, is necessary for the sheathing of the tobacco rod with the cigarette paper which starts at the end of the format finger.

This sheathing of the tobacco rod with the cigarette paper is effected by lateral erection of the format belt, the one end of the cigarette paper projecting out of said format means and being provided with a glue layer. In a subsequent heated device the glued end of the cigarette paper is folded over and glued.

The endless rod sheathed with the cigarette paper thus produced passes through a diameter inspection means and is then cut to the desired cigarette length.

At a point of the format finger, whose position depends on the length of the format finger and its inclination, the diameter of the compacted rod is about 7.85 mm, i.e. equal to the diameter of the finished cigarette but without the double thickness of the cigarette paper.

It has now been found by investigations that the pressure drop of a gas stream of constant volume introduced into the compacted tobacco rod beneath the format finger at a point at which the tobacco rod has a diameter of about 7.85 mm correlates very exactly with the pressure drop in the finished cigarette, i.e. represents an exact reproduceable measure of the draw resistance of the finished cigarette.

Thus, if in cigarette manufacture the tobacco rod is subjected at this point to a gas stream of constant volume and the pressure drop occuring at the tobacco rod is measured, it is possible to calculate in the usual manner from the pressure drop the draw resistance of the cigarettes which are made in the course of the further production from this tobacco rod. Even slight fluctuations of the draw resistance can therefore be immediately detected during the production and used, for example, for controlling the manufacture.

If the gas stream is supplied to the opening in the format finger via a "critically traversed nozzle", i.e. a nozzle which the gas flow leaves with critical velocity, an extremely constant flow volume is obtained as is necessary for the exact determination of the pressure drop at the rod. The critically traversed nozzle is able to furnish the constant gas volume independent of any possible counter pressure produced.

The usual format fingers made from hard metal are not suitable as a "sensor base" because firstly the configuration of the opening(s) desired and still to be explained becomes problematical and secondly these format fingers cannot withstand the loads occuring. In particular, the formation of a plurality of openings in the format finger leads to a reduction of the mechanical strength so that format fingers of sintered or cemented carbide are used, i.e. alloys made by compacting and sintering and having great hardness on the basis of carbides, as sold, for example, under the trademark "WIDIA".

For detecting the pressure drop at the rod, the usual pressure transducers may be used which are suitable for measuring gaseous media and have a suitable measuring range.

The pressure-sensor transducer should be arranged in the rod axially with respect to the influx direction of the gas stream so that even brief density fluctuations of the rod leading to a change in the pressure drop and generating a pressure wave in the gas flow can be detected and taken into account.

If the draw resistance must be determined over a somewhat greater rod length, the pressure pickup should be arranged perpendicularly to the influx direction of the gas stream into the rod. It is also possible to arrange the pressure pickup outside the actual machine area.

The form, size and number of openings in the format finger, through which the rod is subjected to the gas stream, depend on the constructional form of the format finger and on the properties of the rod.

It must, however, also be ensured that the edges of the opening do not obstruct a smooth Jerk-free movement of the rod and also favourably influence the influx of the gas into the rod. This can be achieved if the entry region of the opening in the format finger is formed similar to a diffuser or a nozzle, in particular of the Venturi or Laval nozzle type.

Further influencing of the influx behaviour is possible by appropriate selection of the entry direction of the gas stream into the rod.

The volume flow occuring depends on the one hand on the area of the opening(s) and on the other on the properties of the tobacco rod. Thus, even a slight increase in the volume flow can lead to a large pressure drop. Thus, by appropriate setting of the volume flow, pressure-drop values can be obtained which are very well suited for signal amplification, as is often necessary in the control of the production.

Pressure transducers or sensors available commercially furnish the measured value for the pressure drop at the rod directly as electrical signal which can be used for the control of the cigarette manufacture from the point of view of maintaining a constant draw resistance.

BRIEF DESCRIPTION OF THE INVENTION

The invention will be explained hereinafter in detail with the aid of examples of embodiment with reference to the attached schematic drawings, wherein:

FIG. 1 is a perspective view of a format finger and a format belt of a cigarette machine, and FIG. 2 is a side view of an embodiment of an apparatus for the continuous measurement of the draw resistance of cigarettes during the production.

DESCRIPTION OF THE PREFERRED EMBODIMENTS

Figure 1:
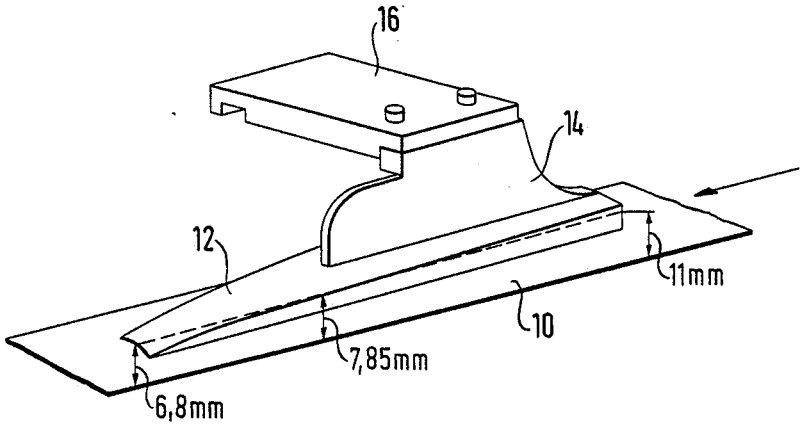

FIG. 1 shows the part of a conventional cigarette machine in which the substantially cylindrical tobacco rod brought up in the direction of the arrow and having a diameter of about 11 mm is compacted to the diameter of about 6.8 mm. The transported tobacco rod lying on a format belt 10 is compacted by a format finger 12, having substantially the form of a hollow semicylinder, to the desired diameter. As apparent in FIG. 1 the format finger 12 is mounted on a vertically arranged, relatively rigid plate 14 which in turn is attached to a horizontal support 16.

Figure 2:
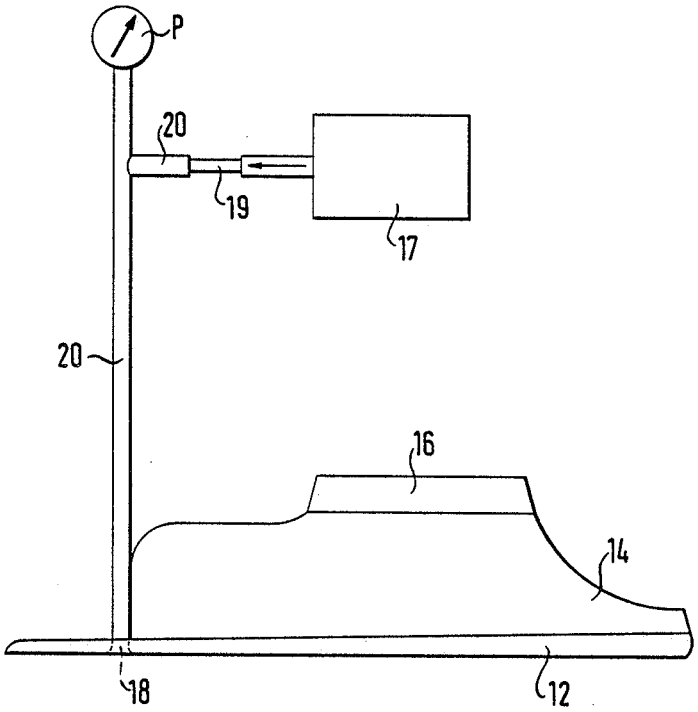

FIG. 2 shows an embodiment of an apparatus for the continuous measurement of the draw resistance of a tobacco rod which is provided on the format finger 12., if it is assumed that the tobacco rod at the entrance into the format finger 12 has a diameter of 11 mm and at the exit a diameter of 6.8 mm, then at the point indicated in FIG. 1 a spacing results between the format (not shown) and format finger 12 which amounts to 7.85 mm. Due to the lateral restriction of the tobacco rod by the format belt 10 covered with cigarette paper and the format finger 12, a compacting density arises at this point which corresponds to the compacting density of the finished cigarette. Such a finished cigarette has a diameter of 7.85 mm of the tobacco rod and a paper thickness of about 0.1 mm.

Now, if the format finger is formed at the point, at which the tobacco rod has a diameter of 7.85 mm, with a continuous opening 18 through which a gas stream of constant volume flows, which is supplied in the direction of the arrow from a source 17 of constant pressure via a hose or conduit 20 with a critical nozzle 19, the flow resistance of the rod results in a pressure drop of the gas stream which can be detected by a conventional pressure transducer P connected to the hose or conduit 20.

FIG. 2 shows an embodiment in which the hose or conduit 20 for the introduction of the gas stream into the opening 18 of the format finger 12 is disposed at the front side of the rigid plate 14 and extends with slight deviation from the perpendicular to the format finger 12 and thus to the transported tobacco rod, i.e. at an angle of about 80° to 83° to the tobacco rod. It is, however, also possible to operate with somewhat greater deviations from the perpendicular, namely at an angle of about 70° to 87°, in particular 78° to 85°.

Due to this slight inclination of the supply direction with respect to the tobacco rod the opening 18 is given a circular or ellipsoidal form depending on the requirement.

In addition, the opening 18 should be designed so that firstly it does not influence the influx of the gas stream and secondly does not interfere with the transport of the tobacco rod. In particular, it is expedient to round the edges of the opening 18 lying on the tobacco rod to avoid disturbing the satisfactory conveying of the tobacco rod.

Furthermore, the inlet region of the opening should be formed similarly to a diffuser or a nozzle, in particular of the Venturi or Laval type.

The area of the opening 18 in the format finger should have a size of 0.5 to 12.00 $mm^2$, in particular 0.6 to 2.0 $mm^2$, since with smaller opening areas the pressure drop deviates greatly. With larger areas, disturbances in the entry region may occur. Good results were obtained with an area of 0.8 $mm^2$.

The constant volume of the gas stream can be varied in the range from 4 to 600 ml/s, in particular between 8 and 140 ml/s, without appreciable deviations from the desired correlation with the static draw-resistance measurement occurring.

If required several openings 18 can be provided in the format finger 12, thereby making possible, for example, formation of an average value for the draw resistance.

Finally, the draw resistance can also be determined from the variable volume with constant pressure drop at the rod, the source of the volume flow being set such that the pressure drop is kept to a predetermined value. The pressure transducer P must then be replaced by a volume meter.

It is possible with this sensor to carry out a control of the cigarette manufacture for constant draw resistance, conveniently via the tobacco-insert weight, i.e. controlling the position of the trimmer discs.

We claim:

1. An apparatus for measuring the draw resistance of a rod of tobacco fibres (a) comprising a source for a gas stream passing through the rod and (b) a measuring-value transducer for determining the pressure drop of the gas stream with constant gas volume occurring at the rod wherein (c) the format finger made from hard metal of a rod-producing machine for the production of smokable articles comprises at a point, at which the diameter of the rod corresponds substantially to the diameter of the finished tobacco rod, at least one opening for subjecting the rod to the gas stream, and (d) the one or each opening is connected via a critically traversed nozzle in the supply conduit to the gas source.

2. An apparatus according to claim 1, wherein the opening has a circular or ellipsoidal shape.

3. An apparatus according to claim 1, wherein the edges of the opening have a shape favorable to the flow.

4. An apparatus according to claim 3 wherein the entry region of the opening is formed as diffuser or nozzle, in particular Venturi or Laval nozzle.

5. An apparatus according to claim 3, wherein the edges of the opening contacting the rod are rounded.

6. An apparatus according to claim 1, wherein the gas stream through the opening impinges on the rod at an angle of 70° to 87°, in particular 78 to 85°.

7. An apparatus according to claim 1, wherein the pressure drop of the gas stream with constant volume at the rod is picked up at the supply conduit of the gas stream.

8. An apparatus according to claim 7, wherein the pressure transducer is arranged axially with respect to the entry direction of the gas stream into the rod in the supply conduit.

9. An apparatus according to claim 1, wherein the format finger comprises a plurality of openings which are subjected to gas flows of different volumes.

10. An apparatus according to claim 9, wherein the openings have different shapes.

11. An apparatus according to claim 1, wherein the area of an opening in the format finger is 0.5 to 12 mm:, in particular 0.6 to 2.0 mm:

12. An apparatus according to claim 1, wherein in the measurement of the pressure drop, the constant volume of the gas stream is 4 to 600 ml/s, in particular 8 to 140 ml/s.

* * * * *

UNITED STATES PATENT AND TRADEMARK OFFICE

CERTIFICATE OF CORRECTION

PATENT NO. : 4,811,744

DATED : March 14, 1989

INVENTOR(S) : Jörn ULRICH et al

It is certified that error appears in the above-identified patent and that said Letters Patent is hereby corrected as shown below:

Column 6, line 50, "12 mm:" should read -- 12 $mm^2$ --;
line 51, "2.0 mm:" should read -- 2.0 $mm^2$ --.

Signed and Sealed this

Ninth Day of February, 1993

*Attest:*

STEPHEN G. KUNIN

*Attesting Officer*

*Acting Commissioner of Patents and Trademarks*